US005819606A

United States Patent [19]

Arnold

[11] Patent Number: 5,819,606

[45] Date of Patent: Oct. 13, 1998

[54] PLASTIC IDENTIFICATION INSERT FOR SOCKETS

[75] Inventor: Robert L. Arnold, Jacobus, Pa.

[73] Assignee: Hand Tool Design Corporation, Wilmington, Del.

[21] Appl. No.: 888,314

[22] Filed: Jul. 14, 1997

[51] Int. Cl.[6] ..... B25B 13/00

[52] U.S. Cl. ..... 81/124.3; 81/DIG. 5; 81/180.1

[58] Field of Search ..... 81/121.1, 180.1, 81/124.6, DIG. 5

[56] References Cited

U.S. PATENT DOCUMENTS

| | | | |
|---|---|---|---|
| 4,825,732 | 5/1989 | Arnold | 81/121.1 |
| 4,947,713 | 8/1990 | Arnold | 81/121.1 |
| 4,969,231 | 11/1990 | Mader et al. | 16/141 R |
| 4,982,627 | 1/1991 | Johnson | 81/121.1 |
| 5,341,707 | 8/1994 | Bond | 81/436 |
| 5,421,224 | 6/1995 | Bond | 81/436 |

*Primary Examiner*—James G. Smith
*Assistant Examiner*—Benjamin M. Halpern
*Attorney, Agent, or Firm*—Leonard Bloom

[57] ABSTRACT

An identification insert for a socket for a ratchet wrench. The insert is a member which is adapted to be received in the opening in the socket and to be retained therein. The identification insert provides color differentiation and has other indicia thereon to provide further identification. A set of sockets having indicia are held on a socket holder.

37 Claims, 5 Drawing Sheets

PLASTIC IDENTIFICATION INSERT FOR SOCKETS

BACKGROUND

The present invention relates to fraction vs. metric size or individual size identification of sockets and more particularly, to an insert to be received in the socket, the insert having color differentiation in addition to other indicia thereon.

BACKGROUND OF THE INVENTION

Sockets for a ratchet wrench and other tools are frequently stored or carried by a worker in a container without any organization. The sockets may be of a variety of sizes to be used with corresponding fasteners and, further may be either metric or fraction sizes.

This need for identification has been recognized by Arnold in U.S. Pat. Nos. 4,825,732 and 4,947,713. These patents disclose a molded elastomeric sleeve on the outer surface of a conventional wrench socket wherein the sleeve shows size indicia data for facilitating a convenient recognition and selection of the socket. In U.S. Pat. No. 4,969,231, Mader et al disclose a hand tool handle having a color coded end cap with indicia. The end cap has a plurality of complementary studs which is disposed over and secured to the rearward portion of the handle. In U.S. Pat. No. 4,982,627, Johnson discloses color coded tools wherein the color marking method includes a recessed identification system on the outer surface of the tool that allows the use of various colors and coloring materials. A color chart is used in conjunction with the tools. Sockets, hand wrenches, hexagonal wrenches, drill bits, are examples of tools that would utilize this color identification system. U.S. Pat. Nos. 5,341,702 and 5,421,224 to Bond discloses indicia on the head of a handle of the tool to indicate tool type so that the user can select the correct tool and tool head type from a group of tools held in a tool belt or pouch. Such tools include hand-held tools as screwdrivers, tapping tools, awls, nutdrivers, pliers, and the like. The indicia can be recessed into or raised from the surface of the handle to provide tactical identify of the configuration and orientation of the tool head.

Although these indicator means have some utility, an improved cost effective and durable system for wrench sockets to distinguish individual sizes or metric from fraction sockets is needed.

BRIEF SUMMARY OF THE INVENTION

It is an object of the invention to provide an insert to a wrench socket to easily visually identify the socket with respect to metric vs. fraction system, or the specific size of the socket and other identification means.

In accordance with the teachings of the present invention, there is disclosed an identification insert for a socket adapted to be used with a ratchet wrench. The socket has a first end adapted to be received on the ratchet wrench and a second end having means therein to cooperate with a workpiece. The first end of the socket has a top sur face having an opening formed therein. The opening has an annular counterbore formed therein. A plastic member has an inner edge, an outer edge, a top surface and a bottom surface. Means are provided to secure the plastic member in the counterbore. The outer edge of the plastic member engages angled walls of the counterbore and the plastic member is retained therein by an interference compression fit.

In further accordance with the teachings of the present invention there is disclosed an identification insert for a socket adapted to be used with a ratchet wrench. The socket has a first end adapted to be received on the ratchet wrench and a second end having means therein to cooperate with a workpiece. The first end of the socket has a top surface having an opening formed therein. The opening has an inner diameter. The insert is a plastic sleeve having a top surface, an inner surface, an outer surface and an outer diameter. The plastic sleeve is received in the opening in the top surface of the socket. The socket and the sleeve have respective detent means thereon to cooperate with one another. The inner diameter of the opening in the socket is slightly less than the outer diameter of the plastic sleeve such that the sleeve is received with a friction fit within the opening. The insert has indicia thereon to provide the identification. The indicia is alpha numeric or a color code on the top surface of the plastic sleeve to identify either a fraction or metric system socket or a specific size socket of either system.

There is additionally disclosed an identification insert for a socket adapted to be used with a ratchet wrench. The socket has a first end adapted to be received on the ratchet wrench and a second end having means therein to cooperate with a workpiece. The first end of the socket has a top surface having an opening formed therein to cooperate with a drive means on the ratchet wrench. A trepan is formed encircling the opening in the top surface. An insert has in inner edge, an outer edge, a top surface and a bottom surface. The insert is disposed in the trepan, and means are provided to secure the insert in the trepan.

In another aspect, there is disclosed a set having a plurality of different sized sockets for a ratchet wrench. Each socket has a first end adapted to be received on the ratchet wrench and a second end having means therein to cooperate with a workpiece. The first end of each socket has a top surface having an opening formed therein. A member is received in the opening in the first end of each socket. Each member has indicia thereon to provide identification. A socket holder is provided having means thereon to removably receive the second end of each socket such that the indicia in the first end of each socket is visible.

These and other objects of the present invention will become apparent from a reading of the following specification taken in conjunction with the enclosed drawings.

DESCRIPTION

Figure 1:
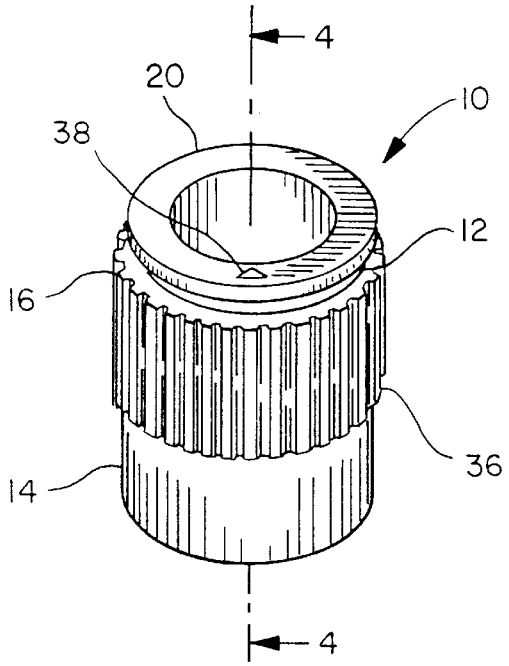
FIG. 1 is a perspective view of an embodiment of the present invention in which the insert extends outwardly from the top surface of the socket.
Figure 3:
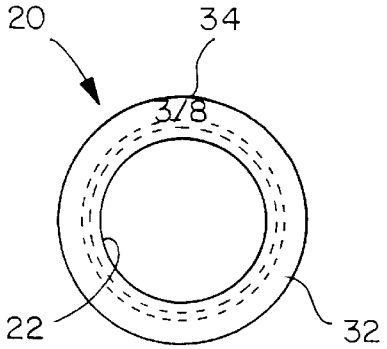
FIG. 3 is a top plan view of the insert of FIG. 1.
Figure 2:
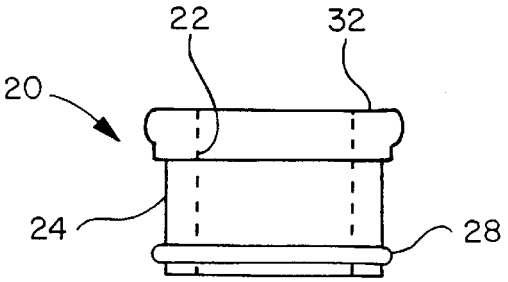
FIG. 2 is a side elevation view of the insert of FIG. 1.

Referring now to FIGS. 1–4, a socket 10 for a ratchet wrench has a first end 12 which is adapted to be received on the ratchet wrench. The opposite second end 14 of the socket has means therein to cooperate with a workpiece. The means may be, for example, a six point or a twelve point opening to fit a nut or similar fastener. The first end 12 of the socket 10 has a top surface 16 which further has a opening 18 formed therein. The opening 18 has an inner diameter.

The identification insert 20 is adapted to be received in the opening 18 in the top surface 16 of the socket 10. In one embodiment, the identification insert 20 is a plastic sleeve with a hollow core having an inner surface 22, an outer surface 24 and an outer diameter. The inner diameter of the opening 18 in the socket is slightly smaller than the outer diameter of the insert 20 such that the sleeve is received with a friction fit within the opening 18.

Figure 4:
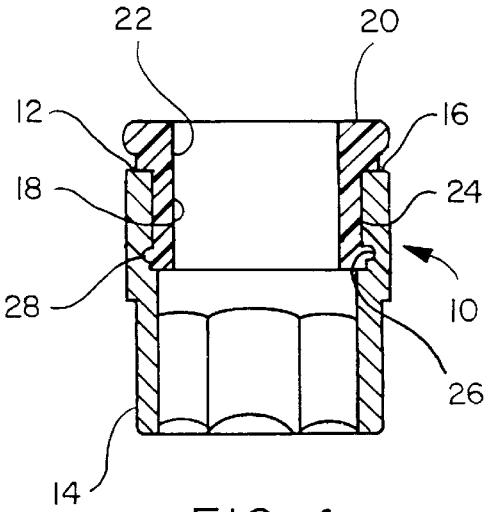
FIG. 4 is a cross-sectional view across the lines 4—4 of FIG. 1.
Figure 5:
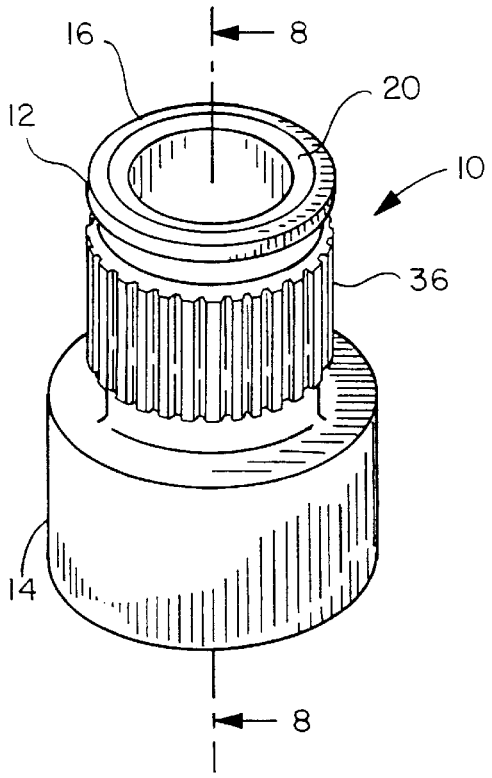
FIG. 5 is a perspective view of an embodiment of the present invention in which the insert is flush with the top surface of the socket.
Figure 7:
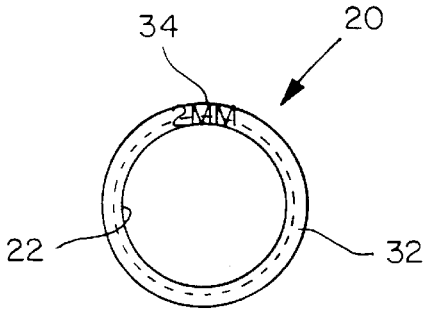
FIG. 7 is a top plan view of the insert of FIG. 5.
Figure 6:
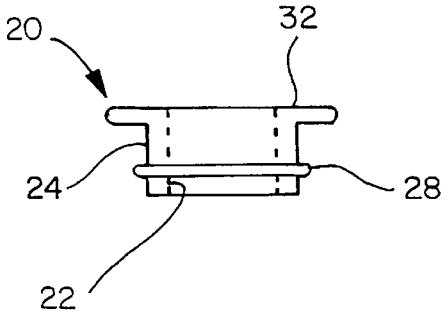
FIG. 6 is a side elevation view of the insert of FIG. 5.
Figure 8:
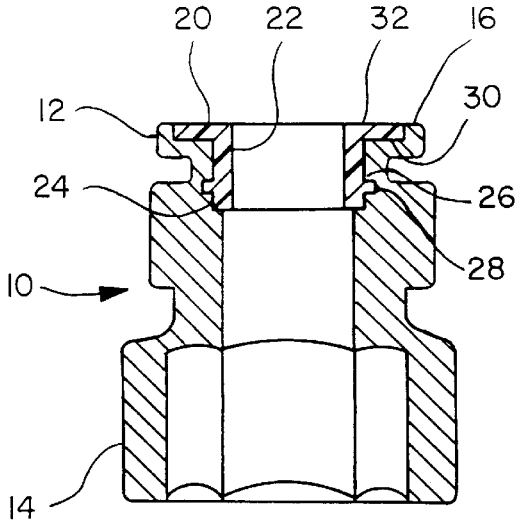
FIG. 8 is a cross-sectional view taken across the lines 8—8 of FIG. 5.

Preferably, the socket 10 and the sleeve 20 each have respective detent means formed thereon. The detent means may be a groove 26 formed circumferentially about the wall of the opening 18 in the socket 10 and a cooperating ridge 28 formed on the outer surface 24 of the sleeve 20 (FIGS. 4 and 8). Alternately, the detent means may be a groove formed in the outer surface of the sleeve and a cooperating ridge formed circumferentially about the wall of the opening in the socket. The detent means together with the friction fit retains the insert 20 in the socket 10.

In the embodiment shown in FIGS. 1–4, the upper portion of the insert 20 has a diameter greater than the diameter of the sleeve portion and, when the sleeve is inserted in the socket, the upper portion abuts the top surface 16 of the socket 10 and extends outwardly therefrom.

In the embodiment shown in FIGS. 5–8, the opening 18 in the socket 10 has a counterbore 30 formed near the top surface 18 such that the upper portion of the sleeve 20 is supported by the counterbore 30. The top surface 32 of the sleeve is flush with the top surface 16 of the socket 10.

The plastic sleeve 20 has indicia (as described below) formed thereon to assist the user in more rapidly visually identifying the socket. The indicia may be a color, as for example red to indicate fraction size sockets and blue to indicate metric size sockets. The indicia may be alpha-numeric formed on the top surface of the plastic sleeve to indicate the size of the socket (for example ½ or 2 mm), or the name of the manufacturer. The alpha-numeric index may be raised above or may be recessed into, the top surface. The index may be a design or logo 38 to indicate the supplier of the socket.

The indicia may also be a different color for each size of socket such as, for example, red, orange, yellow, green, blue, indigo, violet, brown, black and white to be used with ten different sizes of sockets. The fraction sizes may be more intense or deeper shades of these colors as compared to the less intense or paler shades of the respective colors which are used with metric sizes. In this manner, the user can easily distinguish between the various sizes and also between metric and fraction type sockets.

The identification insert 20 is especially useful with a socket 10 which has gear teeth 36 formed on the outer surface of the first end 12 of the socket. The sleeve 20 is hollow and a workpiece can extend completely through the socket so that the socket can be used in those situations when a socket without a through opening cannot be used. Also, the sockets with gear teeth 36 on the outer surface are used in a wrench with a low profile which can be used in confined spaces where access to the workpiece is limited. U.S. patent application Ser. No. 08/760,734 filed Dec. 5, 1996 by Arnold discloses a pawl module used in a ratchet wrench designed to utilize these types of sockets.

Figure 9:
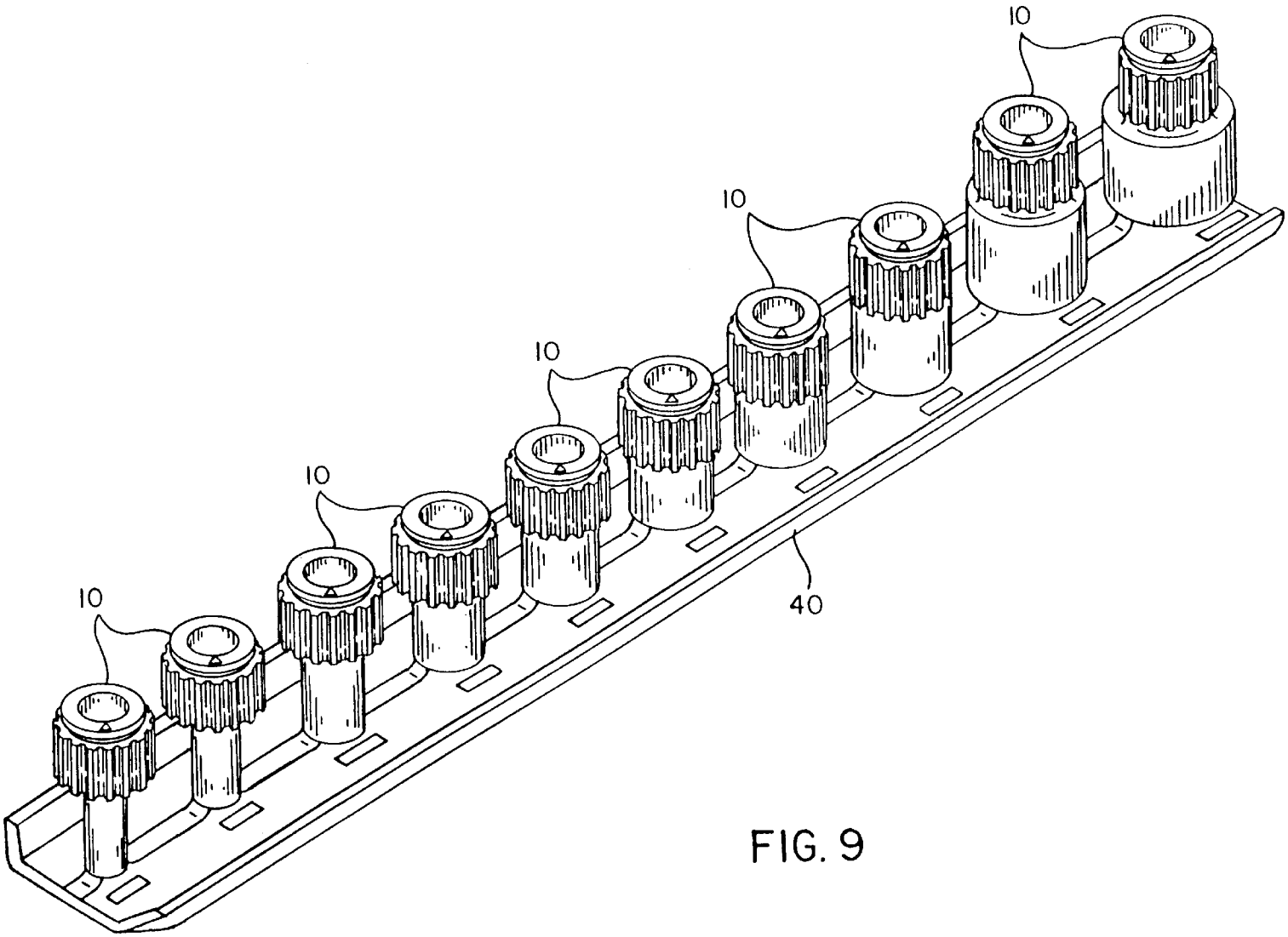
FIG. 9 is a perspective view of a socket holder containing a set of sockets with indicia.
Figure 10:
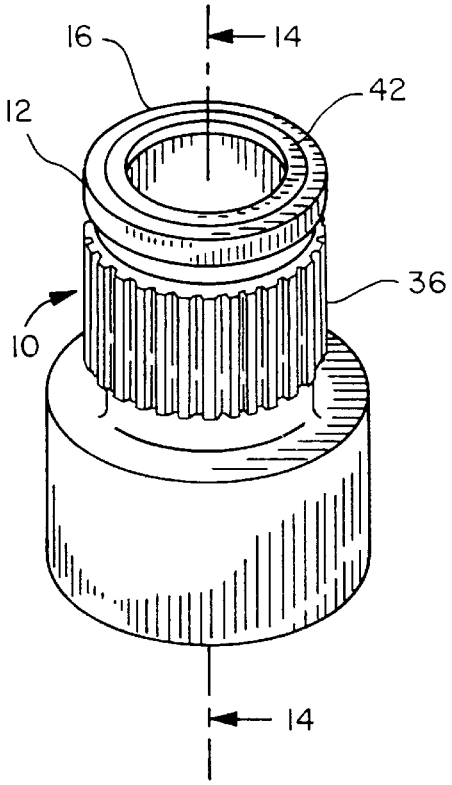
FIG. 10 is a perspective view of an embodiment of the present invention in which the insert is retained in a counterbore in the top surface of the socket.
Figure 11:
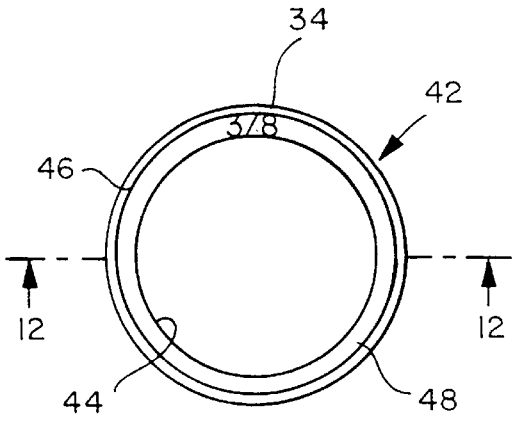
FIG. 11 is a top plan view of the insert of FIG. 10.
Figure 12:
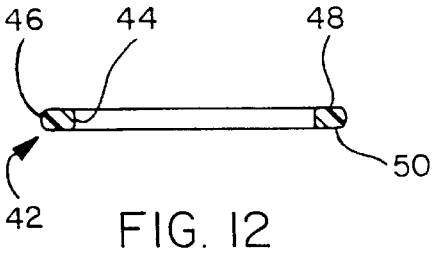
FIG. 12 is a cross-sectional view across the lines 12—12 of FIG. 11.
Figure 14:
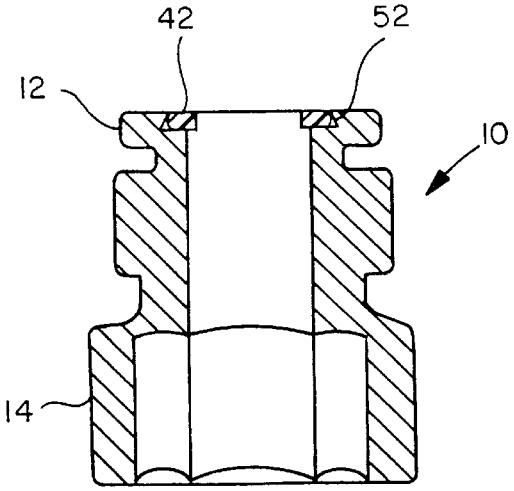
FIG. 14 is a cross-sectional view across the lines 14—14 of FIG. 10.
Figure 13:
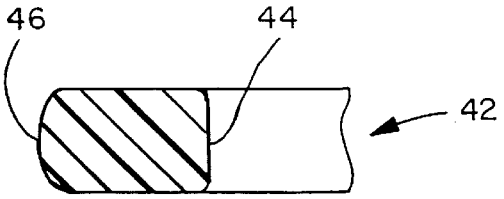
FIG. 13 is an enlarged view of the edge of the insert of FIG. 12.

The sockets (either fraction, metric or both) may be contained or stored as a set in a socket holder 40 (FIG. 9). A separate clip or retaining means is provided on the socket holder 40 to removably receive the second end of each respective socket on the socket holder 40. Each retaining means, or a space adjacent to each retaining means, is color coded to match the respective socket so that the indicia on the respective sockets correspond with the indicia on the socket holder and the sockets can be stored in an orderly manner. Also, without the need to read the socket size, the set graphically shows a missing socket.

Figure 15:
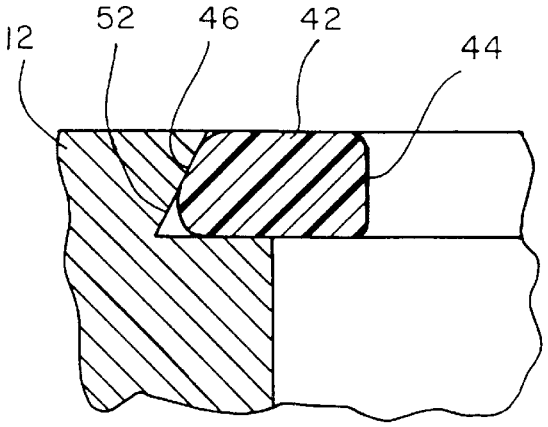
FIG. 15 is an enlarged view of the plastic insert received in the angled wall of the counterbore in the top surface of the socket.

A further embodiment is shown in FIGS. 10–15. The plastic insert is in the form of a washer 48 which has an inner edge 44, an outer edge 46, a top surface 48 and a bottom surface 50. The outer edge 46, preferably, is rounded with a flat portion formed on the outer extremity thereof. The socket 10 has a counterbore 52 formed on the first end 12 thereof. Preferably, the counterbore has walls which are angled at approximately 25° with respect to the top surface 16 of the socket 10. The angle may vary depending on the size and shape of both the plastic insert and the socket. The plastic insert 42 is disposed in the counterbore 52 in the socket and is retained therein by an interference compression fit (FIG. 15). The plastic insert may be retained in the counterbore by other means known to persons skilled in the art such as adhesives and keying techniques between the plastic insert and the socket. The fit is sufficient so that a bolt or other item extending through the opening 18, cannot inadvertently displace the plastic insert 42 from the counterbore 52. The plastic insert 42 is symmetrical such that the top surface 48 and the bottom surface 50 are identical. The plastic insert 42 may be formed of a colored plastic so that the color, as an indicia, is visible on both surfaces. Also, the alpha-numeric or design indicia can be formed on both the top surface 48 and the bottom surface 50. With this structure, there is no need to orient the plastic insert 42 during assembly operations and automated assembly is facilitated.

Figure 16:
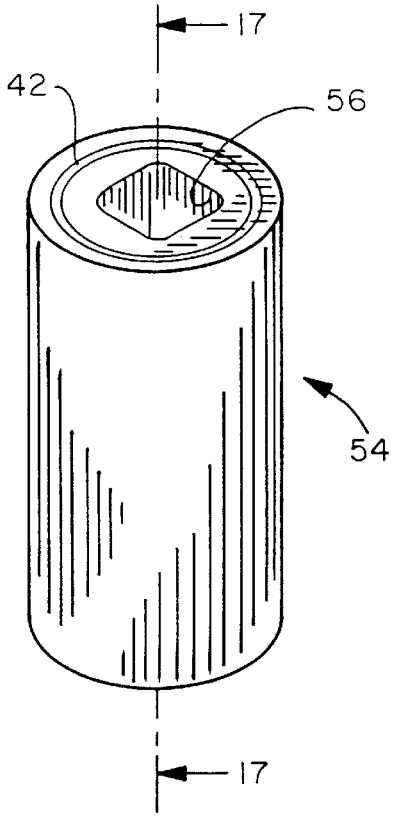
FIG. 16 is a perspective view of an insert disposed in a conventional socket.
Figure 17:
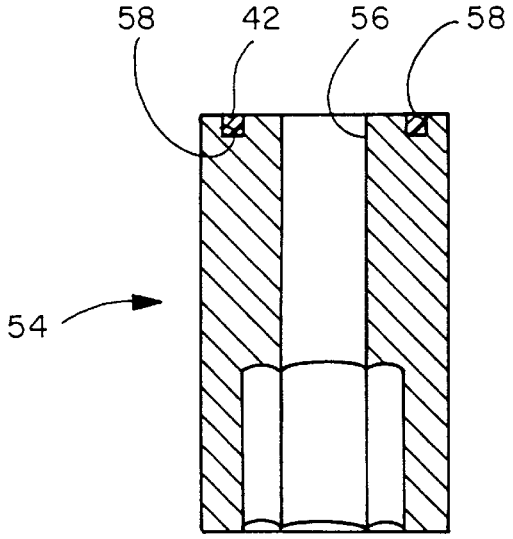
FIG. 17 is a cross-sectional view taken across the lines 17—17 of FIG. 16.

In still another embodiment (FIGS. 16–17), the identification insert may be utilized with a conventional socket 54 having an opening 56 in a top surface to receive a drive means from a ratchet wrench. Typically, the drive means is a square tang and the opening 56, preferably is square to receive the drive tang. A trepan 58 or groove is formed in the top surface of the socket 54 encircling the opening 56. An insert 42 is disposed in the trepan 58 and is retained therein by a keying mechanism, angled walls of the trepan, adhesive or other means known to persons skilled in the art. As previously described, the insert has indicia formed thereon.

The indicia may be color, alpha-numeric, a design or a combination thereof. The insert 42 may be formed from plastic or metal. Alpha-numeric and logo indicia may be stamped into the insert or the insert may be molded to form the indicia. Plastic inserts may be formed from colored material. Metal, such as aluminum, can be anodized to be a desired color.

The inserts of the present invention and the socket holder provide sockets which are visually readily identified by size and system (metric vs. fraction). The present invention overcomes the problems of markings which are stamped or otherwise marked on one location on the outside of the socket. Also, the present invention provides identification which does not wear off and is cost effective.

Obviously, many modifications may be made without departing from the basic spirit of the present invention. Accordingly, it will be appreciated by those skilled in the art that within the scope of the appended claims, the invention may be practiced other than has been specifically described herein.

It is claimed:

1. An identification insert for a socket adapted to be used with a ratchet wrench comprising:

the socket having a first end adapted to be received on the ratchet wrench and a second end having means therein to cooperate with a workpiece, the first end of the socket having a top surface having an opening formed therein, the opening having an annular counterbore formed therein, a plastic insert having an inner edge, an outer edge, a top surface and a bottom surface, and, the plastic insert being disposed in the counterbore, and means to secure the plastic insert in the counterbore.

2. The insert of claim 1, wherein the insert has indicia thereon to provide the identification.

3. The insert of claim 2, wherein the indicia is a color.

4. The insert of claim 3, wherein all fraction size sockets are identified by a first color and all metric size sockets are identified with a second color.

5. The insert of claim 3, wherein each socket of a differing size is identified by a different color, thereby enabling a user to select a desired size by the color of the insert.

6. The insert of claim 2, wherein the indicia is alpha-numeric formed on the top surface and the bottom surface of the plastic insert.

7. The insert of claim 2, wherein the indicia is a design formed on the top surface and the bottom surface of the plastic insert.

8. The identification insert of claim 1, wherein the annular counterbore is formed having a wall which is angled with respect to the top surface of the first end of the socket.

9. The identification insert of claim 8, wherein the angle is approximately 25°.

10. The identification insert of claim 8, wherein the outer edge of the plastic insert engages the angled wall of the counterbore and the plastic insert is retained therein by an interference compression fit.

11. An identification insert for a socket adapted to be used with a ratchet wrench comprising:

the socket having a first end adapted to be received on the ratchet wrench and a second end having means therein to cooperate with a workpiece, the first end of the socket having a top surface having an opening formed therein, the opening having an inner diameter, a plastic insert sleeve having a top surface, an inner surface, an outer surface, and an outer diameter, the plastic sleeve being received in the opening in the top surface of the socket, and the socket and the insert sleeve having respective detent means thereon to cooperate with one another.

12. The identification insert of claim 11, wherein the inner diameter of the opening in the socket is slightly less than the outer diameter of the plastic insert sleeve such that the sleeve is received with a friction fit within the opening.

13. The insert of claim 11, wherein the insert sleeve has indicia thereon to provide the identification.

14. The insert of claim 13, wherein the indicia is a color.

15. The insert of claim 14, wherein all fraction size sockets are identified by a first color and all metric size sockets are identified with a second color.

16. The insert of claim 14, wherein each socket of a differing size is identified by a different color, thereby enabling a user to select a desired size by the color of the insert.

17. The insert of claim 13, wherein the indicia is alpha-numeric formed on the top surface of the plastic insert sleeve.

18. The insert of claim 13, wherein the indicia is a design formed on the top surface of the plastic insert sleeve.

19. The identification insert of claim 11, wherein the top surface of the plastic insert sleeve extends outwardly from the top surface of the socket.

20. The identification insert of claim 11, wherein the top surface of the plastic insert sleeve is substantially flush with the top surface of the socket.

21. The identification insert of claim 11, wherein the cooperating detent means is a circumferential groove formed about the opening in the socket and a circumferential ridge formed on the outer surface of the insert sleeve, the groove and the sleeve cooperating to retain the insert sleeve in the opening.

22. An identification insert for a socket adapted to be used with a ratchet wrench comprising:

the socket having a first end adapted to be received on the ratchet wrench and a second end having means therein to cooperate with a workpiece, the first end of the socket having a top surface having an opening formed therein to cooperate with a drive means on the ratchet wrench, a trepan being formed encircling the opening in the top surface, an insert having an inner edge, an outer edge, a top surface and a bottom surface, the insert being disposed in the trepan, and means to secure the insert in the trepan.

23. The insert of claim 22, wherein the insert has indicia thereon to provide the identification.

24. The insert of claim 23, wherein the indicia is a color.

25. The insert of claim 24, wherein all fraction size sockets are identified by a first color and all metric size sockets are identified with a second color.

26. The insert of claim 24, wherein each socket of a differing size is identified by a different color, thereby enabling a user to select a desired size by the color of the insert.

27. The identification insert of claim 21, wherein the indicia is alpha-numeric formed on the top surface and the bottom surface of the plastic insert.

28. The insert of claim 23, wherein the indicia is a design formed on the top surface and the bottom surface of the plastic insert.

29. A set comprising a plurality of different sized sockets for a ratchet wrench, each socket having a first end adapted to be received on the ratchet wrench and a second end having means therein to cooperate with a workpiece, the first end of each socket having a top surface having an opening formed therein:

an insert received in the opening in the first end of each socket, each insert having indicia thereon to provide identification, and a socket holder having means thereon to removably receive the second end of each socket such that the indicia in the first end of each socket is visible.

30. The set of claim 29, wherein the socket holder has a plurality of indicia attached thereto, the indicia being disposed adjacent to the means to receive the second end of each socket wherein the indicia on the socket holder correspond to the indicia on each socket and placement of each socket on the socket holder is facilitated.

31. In combination with a ratchet wrench including a head portion having an opening formed therein, a wrench socket received in the opening in the head portion of the ratchet wrench, the wrench socket comprising a lower portion provided with a socket for engaging a fastener, an upper portion provided with a cylindrical bore in communication with the socket in the lower portion, wherein a through opening is formed in the socket, the upper portion of the wrench socket having a gear formed externally thereon, and an insert carried by the upper portion of the wrench socket, the insert having identification means thereon.

32. The combination of claim 31, wherein the cylindrical bore in the upper portion of the wrench socket is provided with a counterbore, and wherein the insert comprises a molded plastic ring secured within the counterbore.

33. The combination of claim 32, wherein the insert is color coded.

34. The combination of claim 31, wherein the insert comprises a molded plastic sleeve secured within the cylindrical bore in the upper portion of the wrench socket.

35. The combination of claim 34, wherein the insert is color coded.

36. The combination of claim 31, wherein the upper portion of the wrench socket has a top planar surface provided with a trepan, and wherein the insert comprises a molded plastic ring secured within the trepan.

37. The combination of claim 31, wherein the insert is color coded.

* * * * *